United States Patent [19]

Boe

[11] Patent Number: 4,464,107

[45] Date of Patent: Aug. 7, 1984

[54] ELECTRODE ARRANGEMENT FOR AN OIL OR GAS BURNER

[75] Inventor: Ove S. Boe, Sønderborg, Denmark

[73] Assignee: Danfoss A/S, Nordborg, Denmark

[21] Appl. No.: 538,113

[22] Filed: Oct. 3, 1983

[30] Foreign Application Priority Data

Oct. 27, 1982 [DE] Fed. Rep. of Germany ..... 3239673

[51] Int. Cl.[3] ..... F23Q 3/00

[52] U.S. Cl. ..... 431/264

[58] Field of Search ..... 431/264–266; 219/267

[56] References Cited

U.S. PATENT DOCUMENTS

| | | | |
|---|---|---|---|
| 2,311,601 | 2/1943 | Slaght | 431/264 |
| 2,544,930 | 3/1951 | Malek | 431/266 |
| 2,960,980 | 11/1960 | Williams et al. | 431/266 |

*Primary Examiner*—Carroll B. Dority, Jr.

*Attorney, Agent, or Firm*—Wayne B. Easton

[57] ABSTRACT

The invention relates to an arrangement for mounting an electrode in a supporting plate. The plate has a hole, a cylindrically shaped fitting having a diameter smaller than the hole and a flange larger than the hole is mounted in the hole. A retaining spring attached to the plate biasingly engages the flange against the supporting plate. An electrode rod extends through a central bore of the fitting. A spring clamps the fitting to the electrode rod.

3 Claims, 4 Drawing Figures

ELECTRODE ARRANGEMENT FOR AN OIL OR GAS BURNER

The invention relates to an electrode arrangement for an oil or gas burner in which a rod electrode of ceramic material such as silicon carbide passes through a fitting which in turn engages through a hole in a supporting plate fixed with respect to the housing, a retaining spring secured to the supporting plate pressing a fitting portion of larger diameter than the hole against the supporting plate and wherein particularly a clamping spring engaging through the wall of the fitting secures the rod electrode against axial displacement.

In a fictitious state of the art according to German Patent Application No. P 31 43 432.0, a rod electrode of ceramic material has been used which is held in its fitting by means of a clamping spring in the shape of a hair clip. The fitting comprises a spherical fitting portion which is pressed against the edge of the hole in the supporting plate by means of a retaining spring wound from wire. In this way, adjustment of the undeformable ceramic rod can be effected.

In many cases, however, such a possibility of adjustment is not necessary or even undesirable because the electrode can be inadvertently brought into a wrong position if, during assembly or dismantling of the burner, for example for the purpose of dismantling the nozzle, the rod ceramic electrode is knocked. The consequences are even worse if the electrode is fixed to the supporting plate and knocking then takes place during assembly or dismantling of the burner. This is because the ceramic rod has a low fracture strength and can easily break off when stressed in this way.

The invention is based on the problem of providing an electrode arrangement of the aforementioned kind in which the ceramic electrode has a defined position but there is nevertheless little danger of it breaking when subjected to unavoidable mechanical loads, particularly impacts.

This problem is solved according to the invention in that the fitting comprises a flange with a planar end face which is pressed by the retaining spring against the surface of the supporting plate and, adjoining same, a section of somewhat smaller diameter than the hole.

In this construction, the ceramic electrode has an accurately defined position by reason of abutment of the flange at the surface of the supporting plate. However, when a lateral force and particularly an impact acts on the electrode, the latter can deflect laterally. This is because the forces are transmitted to the fitting. The latter tends to tilt against the force of the retaining spring because the hole in the supporting plate is sufficiently large to permit such movement and because the flange forms a spring-loaded pivot lever lying against the supporting plate at one point during this tilting movement. When the lateral force disappears, the electrode returns to its defined rest position. A fitting of this construction also tends to take up axial forces resiliently.

Advantageously, the retaining spring engages the flange at only two diametrally opposite abutment points with substantially equal spring force. In this way, the spring force opposing the tilting motion is substantially independent of the radial direction in which the force acts on the electrode.

This can be particularly embodied in that the retaining spring is of sheet metal and the abutment positions formed by two embossments have equal spacings from the securing position of the retaining spring at the supporting plate.

One preferred example of the invention will now be described in more detail with reference to the drawing, wherein.

Figure 1:
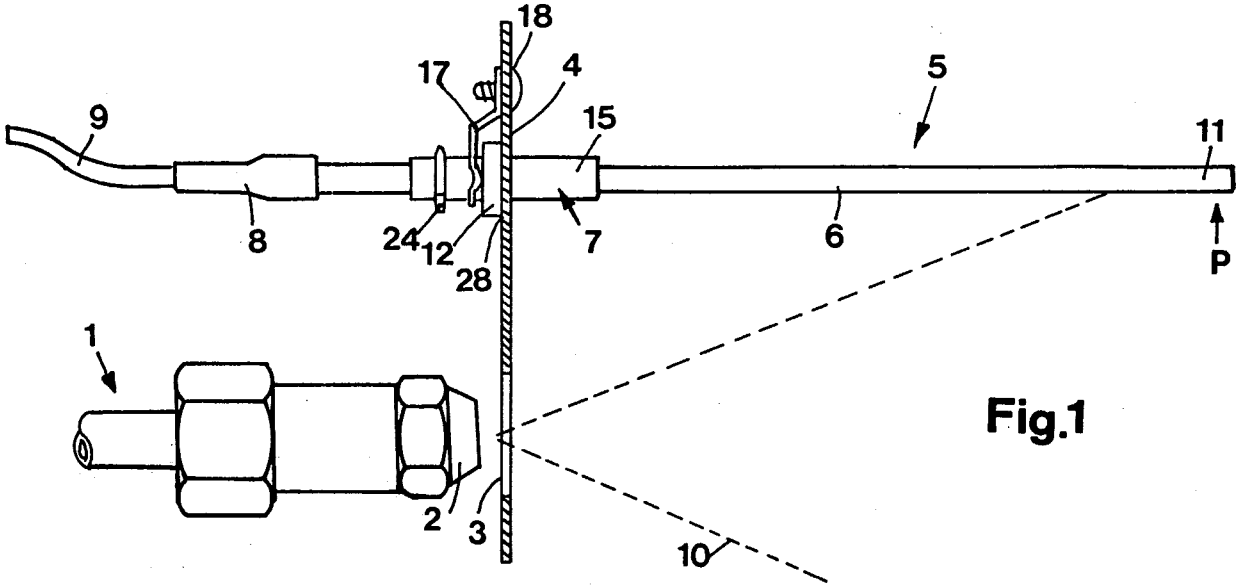
FIG. 1 shows an embodiment of the electrode arrangement according to the invention in the built-in condition.

FIG. 1 illustrates a nozzle bar 1 with a nozzle 2 arranged in front of an aperture 3 in a supporting plate 4 which serves as a baffle plate. An electrode arrangement 5 comprises a rod electrode of silicon carbide which passes through a fitting 7 onto which the rear end of a round plug 8 with a connecting cable 9 is pushed. The nozzle 2 discharges fuel in a cone 10. The front end 11 of the electrode 6 is disposed in the region of the flame.

Figure 4:
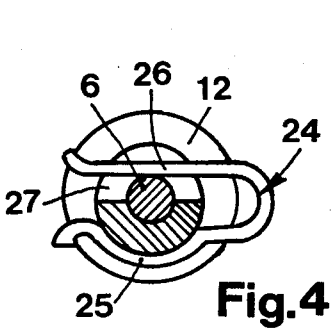
FIG. 4 is a cross-section in the region of the clamping spring.
Figure 3:
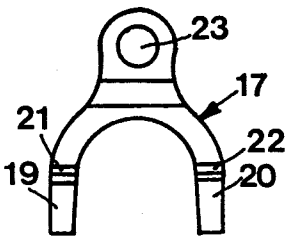
FIG. 3 is an elevation of one embodiment of a retaining spring.
Figure 2:
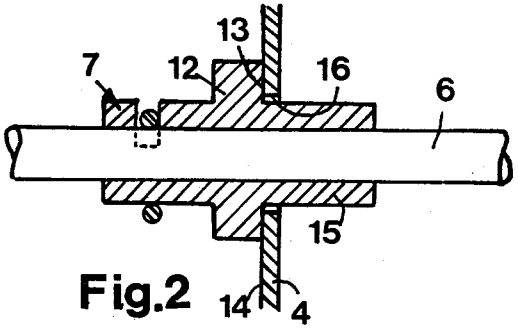
FIG. 2 is an enlarged section through the fitting region.

The fitting 7 comprises a flange 12 lying against the planar surface 14 of the supporting plate 4 with its planar end face 13 and having a cylindrical portion 15 passing through a hole 16 in the supporting plate 4. As shown in FIG. 2, the diameter of the cylindrical portion 15 is somewhat smaller than the diameter of the hole 16. A retaining spring 17 is secured to the supporting plate 14 by means of a self-threading screw 18. The retaining spring consists of sheet metal and has two arms 19 and 20, each with one embossment 21 or 22 with which it lies against the flange 12 at diametrally opposite positions. The embossments 21 and 22 are equally spaced from the securing position 23 and therefore exert equal forces on the flange 12. A clamping spring 24 serves as a hair clip spring of which the arm 25 engages under the fitting 7 and the other arm 26 engages through a slot 27 in the fitting 7 to act on the electrode 6.

In this electrode arrangement, the axis of electrode 6 has a defined direction predetermined by abutment of flange 12 against the supporting plate 14. The electrode can be displaced against the force of clamping spring 24 until its front end 11 is disposed at the correct position. If a transverse force P acts on the electrode 6, the electrode 6 can deflect somewhat because its fitting 7 can be displaced against the force of the retaining spring 17. In the illustrated case, the flange 12 tilts about point 28, the rest of the flange lifting off the supporting wall 4 as the two arms 19 and 20 of the retaining spring 17 are deformed. Since the diameter of hole 16 is somewhat larger than the diameter of the cylindrical section 15, such an oblique position is possible. By reason of the elastic taking up of such forces P, breaking of the electrode 6 is prevented.

If the force P acts in the plane of the drawing, the points of engagement of the force of the retaining spring 17, represented by the embossments 21 and 22, are spaced from the pivot point 28 by the mean radius of flange 12. However, the forces of both arms 19 and 20 are effective. On the other hand, if the force P is normal to the plane of the drawing, one of the embossments 21 is so close to the pivot point that it is practically ineffective. Instead, the point of abutment of the other arm is spaced practically twice the radius of the flange 12 so that this arm is bent to a correspondingly greater extent. In effect, the forces exerted by the retaining spring 17 are substantially equal irrespective of the direction of force P.

As a whole, one achieves an electrode arrangement in which the electrode has a very long life because it is of ceramic and therefore chemically inert as well as thermally resistant and because it can deflect to a limited extent when mechanically loaded. Instead of the illustrated retaining spring 17 of sheet metal, a wire spring can also be used. In simpler cases, it suffices if the spring lies against the flange 12 at only one side of the electrode axis.

I claim:

1. An electrode assembly for an oil or gas burner, comprising, a vertical housing supporting plate having a hole of a predetermined size, a cylindrically shaped fitting having a diameter somewhat smaller than the diameter of said hole and a centrally located flange having a diameter somewhat larger than the diameter of said hole, retaining spring means attached to said supporting plate and biasingly engaging said flange against said supporting plate, said fitting having a central bore, an electrode rod disposed in said bore, and clamping spring means securing said rod in said fitting bore.

2. An electrode assembly according to claim 1 wherein said retaining spring means engage said flange at two diametrically opposite points on said flange with substantially equal spring force.

3. An electrode assembly according to claim 2 wherein said retaining spring means is of sheet metal and has a head portion attached to said supporting plate and bifurcated leg portions with each leg portion having an embossment engaging said flange, said embossments being equally spaced from said head portion.

* * * * *